US011738593B2

(12) United States Patent
Webster, III

(10) Patent No.: US 11,738,593 B2
(45) Date of Patent: Aug. 29, 2023

(54) COVER ASSEMBLY FOR A GARAGE DOOR

(71) Applicant: William Gardiner Webster, III, Rancho Palos Verdes, CA (US)

(72) Inventor: William Gardiner Webster, III, Rancho Palos Verdes, CA (US)

( * ) Notice: Subject to any disclaimer, the term of this patent is extended or adjusted under 35 U.S.C. 154(b) by 0 days.

(21) Appl. No.: 17/532,820

(22) Filed: Nov. 22, 2021

(65) Prior Publication Data

US 2023/0158826 A1 May 25, 2023

Related U.S. Application Data

(60) Provisional application No. 63/131,217, filed on Dec. 28, 2020.

(51) Int. Cl.

| | |
|---|---|
| ***E06B 3/70*** | (2006.01) |
| ***B44C 1/20*** | (2006.01) |
| ***B44C 1/28*** | (2006.01) |

(52) U.S. Cl.

CPC ..... *B44C 1/20* (2013.01); *B44C 1/28* (2013.01); *E06B 3/7001* (2013.01); *E06B 2003/7044* (2013.01)

(58) Field of Classification Search

CPC . E06B 3/7001; E06B 2003/7044; B44C 1/20; B44C 1/28

See application file for complete search history.

(56) References Cited

U.S. PATENT DOCUMENTS

| | | | | | |
|---|---|---|---|---|---|
| 2,249,927 | A * | 7/1941 | Abramson | E06B 3/7001 | 160/237 |
| 4,372,364 | A * | 2/1983 | Katz | E04G 21/30 | 383/7 |
| 5,042,656 | A * | 8/1991 | Kahre | B05B 12/24 | 206/321 |
| 5,123,223 | A * | 6/1992 | Makarevich | E06B 7/28 | 52/311.1 |
| 5,255,727 | A * | 10/1993 | Saruwatari | E06B 7/28 | 206/321 |
| 5,351,733 | A * | 10/1994 | Ullman | E06B 7/28 | 206/321 |
| 5,427,169 | A * | 6/1995 | Saulters | E06B 9/0692 | 160/DIG. 18 |
| 5,603,194 | A * | 2/1997 | Fridlyand | E06B 3/7001 | 49/501 |
| 5,839,237 | A * | 11/1998 | Davidson | E06B 3/7001 | 52/63 |
| 5,922,437 | A * | 7/1999 | Bryant | B65D 65/02 | 428/102 |

(Continued)

*Primary Examiner* — Beth A Stephan

(57) ABSTRACT

A cover for a garage door which includes a front portion adapted to cover a street facing surface of the garage door, and a pair of rear portions adapted to be arranged covering a garage facing surface of the garage door. The cover also includes at least four collars adapted to be arranged at corners of the garage door. Each collar defines a cutout extending inwardly from an edge of the cover to facilitate an extension of an associated corner of the garage door outside the cover, a first coupling portion extending along the rear portion from the cutout to a lateral edge of the cover, and a second coupling portion extending from the cutout in a direction opposite to the first coupling portion. The first coupling portion is adapted to engage with the second coupling portion.

17 Claims, 7 Drawing Sheets

(56) References Cited

U.S. PATENT DOCUMENTS

| | | | | |
|---|---|---|---|---|
| 5,937,587 | A * | 8/1999 | Zinbarg | E06B 3/7001 52/63 |
| 6,395,369 | B1 * | 5/2002 | Randone | G09F 17/00 362/267 |
| 6,572,238 | B1 * | 6/2003 | Johnson | F21V 33/006 362/147 |
| 7,198,835 | B2 * | 4/2007 | Anderson | A47H 99/00 52/311.1 |
| 10,676,982 | B1 * | 6/2020 | Harris | E06B 3/485 |
| 10,854,120 | B2 * | 12/2020 | Mahan | G09F 23/00 |
| 11,242,708 | B1 * | 2/2022 | Hall | E06B 3/7001 |
| 2003/0226846 | A1 * | 12/2003 | Horwath | B65F 1/16 150/154 |
| 2006/0027344 | A1 * | 2/2006 | Lampe | G09F 19/22 160/209 |
| 2007/0062136 | A1 * | 3/2007 | Kim | E06B 3/7001 52/311.2 |
| 2009/0047535 | A1 * | 2/2009 | Crilly | E06B 7/28 428/542.6 |
| 2010/0108210 | A1 * | 5/2010 | Salas Garcia | A47H 21/00 150/154 |
| 2010/0251654 | A1 * | 10/2010 | Paul | E06B 3/7001 52/506.05 |
| 2013/0105092 | A1 * | 5/2013 | Rainaldi | E06B 3/7001 160/90 |

* cited by examiner

COVER ASSEMBLY FOR A GARAGE DOOR

CROSS-REFERENCE TO RELATED APPLICATION

This application is a non-provisional application claiming the benefit of priority to U.S. Provisional Application Ser. No. 63/131,217, titled "Flexible Garage Door Decorative Cover", filed on Dec. 28, 2020, which is incorporated herein by reference in its entirety.

TECHNICAL FIELD

This present disclosure generally relates to a cover assembly for a garage door. More particularly, the present disclosure relates to a cover assembly having seasonal, holiday, festive, sporting, or celebratory displays and is temporarily affixed to a movable garage door to provide an exterior decoration.

BACKGROUND

Decorating a residence has become analogous with the holiday season. It is commonplace to adorn the street facing façade of one's home with holiday lights, seasonal displays, and celebratory decorations. In most cases, homeowners seek efficient, safe, and cost-effective means to display their festive ornamentation.

In homes having a garage, one of the largest unobstructed flat surfaces is the garage door. Garage doors are typically constructed from sturdy materials and spend most of their operable life in the closed position. Therefore, the garage door's exterior facing surface is particularly well suited to support a large decorative display; that is, unless the display hinders the operation of the door. Typical residential homes are equipped with two operational door variants: Sectional and Tilt-up. While both variants provide as an adequate mounting surface, both do not easily support an affixed decorative cover during operation.

Sectional garage doors are especially challenging, as during the opening and closing cycles hinged door panels having lateral wheels must be allowed to ride unincumbered along a track. Additionally, as each hinged panel transitions through the opening and closing cycle gaps are formed between the individual panels at the hinges running the entirety of the spanwise exterior face of the garage door. As these gaps form, the vertical dimension (i.e., the distance from the bottommost edge to the topmost edge) of the garage door materially increases. Therefore, this recurring change in the garage door dimension limits the application of a dimensionally fixed decorative cover.

To address this problem, many examples in the prior art seek to equip a dimensionally fixed cover material to the exterior face of a garage door utilizing different forms of elastic clips, bands, hooks, or clamps. These additional components are integral to the cover material and must be utilized in conjunction to achieve the desired operational and aesthetic outcome Examples, as seen in U.S. Pat. Nos. 5,937,587A and 6,035,919A, both solutions describe the application of an "elongate flexible member", or "resilient member" affixed to the lower edge of the garage door. This "member" is then attached via coupling means (e.g., snaps, holes, hooks, hardware) to the decorative door cover. In both examples the "member" is solely responsible for the vertical compensation of the decorative cover to accommodate the exterior surface of the garage door during the opening and closing cycles.

While both solutions provide the necessary elasticity of the affixed decorative door cover, there are several drawbacks. Firstly, the "member" or "members" must be affixed to the garage door and decorative cover in multiple locations along the bottommost and topmost edges of the garage door. This process is cumbersome, time consuming and possibly damaging to vital garage door components. Secondly, the "members" are easily lost, damaged or broken during installation and storage. Thirdly, the "members" do not uniformly maintain tension throughout the decorative cover. As a result, when the garage door is closed creases in the cover material, created during storage or shipment, are not adequately removed.

It should be noted that further examples found in U.S. Pat. No. 20030026940A1, U.S. Pat. No. US20140251554A1, and U.S. Pat. No. 20030026940A1 describe a decorative door cover which wraps around the edges of a hinged door, affixed to a door jamb. These solutions employ a combination of elastic materials and/or integrated elastic bands allowing the cover material to "wrap" and thus affix to the four corners of a hinged door (e.g., front door, side door, bedroom door).

While these solutions allow a decorative door cover to remain taut between a hinged door and door jamb, they are inadequate when applied on a larger more mechanically complex garage door. Firstly, hinged door panels of a sectional garage door utilize lateral wheels that must be allowed to ride unincumbered along a track. Wrapping the cover material around each corner would impede the transition between the open and closed states of the door. Secondly, garage doors are frequently constructed of rough-cut materials. The four corners of the door typically exhibit sharp edges, extrusions, and fasteners. A combination of tensile stress and the repeated opening and closing of the garage door would result in tearing/cutting of the decorative cover in these "wrapping" locations

SUMMARY

It is therefore an object of the disclosure to provide a cover assembly and a cover which when attached to the surface of a garage door permits the garage door to open and close without the cover becoming detached or impeding the operation of the garage door.

It is another object of the disclosure to provide a cover assembly and a cover which is held taut and has a uniform crease free appearance on the exterior surface of the garage door.

It is a further object of the disclosure to provide a cover assembly and a cover which may be easily attached and detached from the garage door.

It is also an object of the disclosure to provide a cover assembly and a cover which, upon removal, will not mar the garage door surface to which it is attached.

It is still a further object of the disclosure to provide a cover assembly and a cover for a garage door which is machine washable and weather resistant.

In accordance with these objects, the disclosure a cover for a garage door is disclosed. The cover includes a front portion adapted to cover a street facing surface of the garage door, and a pair of rear portions adapted to be arranged covering a garage facing surface of the garage door. The front portion is arranged between the pair of rear portions. The cover also includes at least four collars adapted to be arranged at corners of the garage door and arranged at interfaces of the front portion with the pair of rear portions. Each collar defines a cutout extending inwardly from an edge of the cover and adapted to facilitate an extension of an associated corner of the garage door outside the cover, a first coupling portion extending along the rear portion from the cutout to a lateral edge of the cover, and a second coupling portion extending from the cutout in a direction opposite to the first coupling portion and along a portion of a length of the front portion. The first coupling portion is adapted to engage with the second coupling portion to removably engage the cover on the garage door.

In an embodiment, each collar includes a reinforced hem.

In an embodiment, the front portion of the cover includes at least one decorative illustration.

In an embodiment, the cover is made of an elastic fabric.

In an embodiment, the cover further includes a first longitudinal edge and a second longitudinal edge arranged opposite to the first longitudinal edge and the collars are defined along the first longitudinal edge and the second longitudinal edge.

According to another aspect of the disclosure, a cover assembly for a garage door is provided. The cover assembly includes a cover having a front portion adapted to cover a street facing surface of the garage door and a pair of rear portions adapted to be arranged covering a garage facing surface of the garage door. The front portion is arranged between the pair of rear portions. The cover further includes at least four collars adapted to be arranged at corners of the garage door and arranged at interfaces of the front portion with the pair of rear portions. Each collar defines a cutout extending inwardly from an edge of the cover and adapted to facilitate an extension of an associated corner of the garage door outside of the cover. The collar also includes a first coupling portion extending along the rear portion from the cutout to a lateral edge of the cover and a second coupling portion extending from the cutout in a direction opposite to the first coupling portion and along a portion of a length of the front portion. The first coupling portion is engaged with the second coupling portion to removably engage the cover on the garage door.

In an embodiment, the cover assembly includes a plurality of couplers to engage the first coupling portion of each collar with a corresponding second coupling portion.

In an embodiment, the coupler is a zipper.

In an embodiment, each collar includes a reinforced hem.

In an embodiment, the front portion of the cover includes at least one decorative illustration.

In an embodiment, the cover is made of an elastic fabric.

In an embodiment, the cover includes a first longitudinal edge and a second longitudinal edge arranged opposite to the first longitudinal edge and the collars are defined along the first longitudinal edge and the second longitudinal edge.

According to yet another aspect of the disclosure, a cover assembly for a garage door is disclosed. The cover assembly includes a cover made of an elastic fabric. The cover includes a front portion adapted to cover a street facing surface of the garage door and a pair of rear portions adapted to be arranged covering a garage facing surface of the garage door. The front portion is arranged between the pair of rear portions. The cover also includes at least four collars adapted to be arranged at corners of the garage door and arranged at interfaces of the front portion with the pair of rear portions. Each collar defines a cutout extending inwardly from an edge of the cover and adapted to facilitate an extension of an associated corner of the garage door outside of the cover. The collar also includes a first coupling portion extending along the rear portion from the cutout to a lateral edge of the cover, and a second coupling portion extending from the cutout in a direction opposite to the first coupling portion and along a portion of a length of the front portion. The cover assembly also includes a plurality of couplers to engage the first coupling portion of each collar with a corresponding second coupling portion to removably engage the cover on the garage door.

In an embodiment, the coupler is a zipper.

In an embodiment, each collar includes a reinforced hem.

In an embodiment, the front portion of the cover includes at least one decorative illustration.

In an embodiment, the cover includes a first longitudinal edge and a second longitudinal edge arranged opposite to the first longitudinal edge and the collars are defined along the first longitudinal edge and the second longitudinal edge.

Additional objects and advantages of the disclosure will become apparent to those skilled in the art upon reference to the detailed description taken in conjunction with the provided figures.

Additional aspects and advantages will be apparent from the following detailed description of example embodiments, which proceeds with reference to the accompanying drawings.

DETAILED DESCRIPTION

Figure 1:
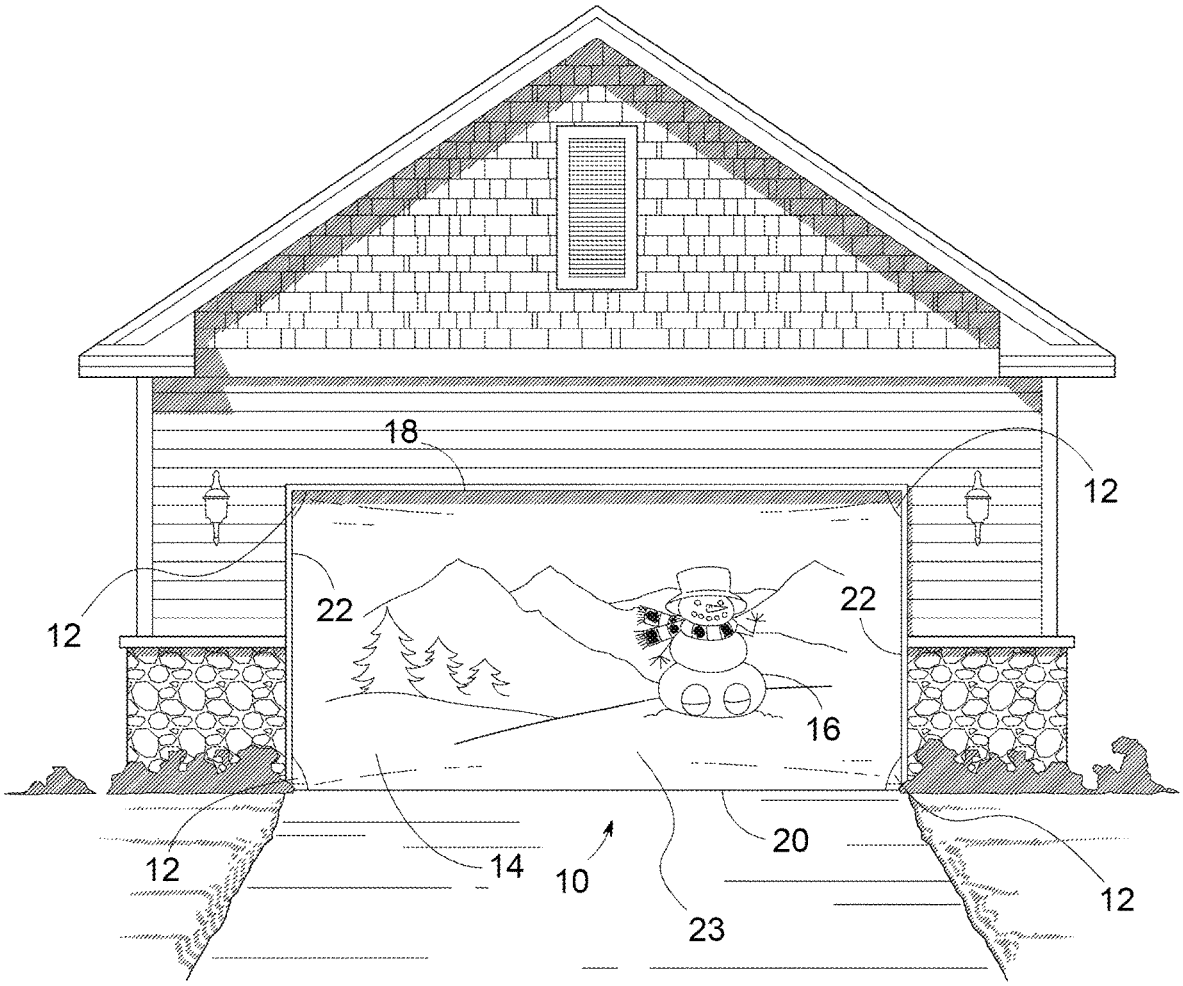
FIG. 1 is a front view of a cover assembly attached to a garage door arranged in a closed position.

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc., mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Turning now to FIG. 1, a cover assembly 10 attached to a typical residential garage door 12 is shown. The cover assembly 10 includes a cover 14 adorned with an illustration 16. Preferably, the illustration 16 is of a fanciful holiday, seasonal, sporting, or other celebratory nature. Moreover, the cover 14 may be made of a fabric that is weather resistant and machine washable. In an embodiment, the fabric may be a flexible and/or an elastic fabric. The cover assembly 10 is adapted to wrap around a topmost edge 18, a bottommost edge 20, and sidemost edges 22 of the garage door 12 and remains taught while the garage door 12 is in both the open and closed states.

Figure 2:
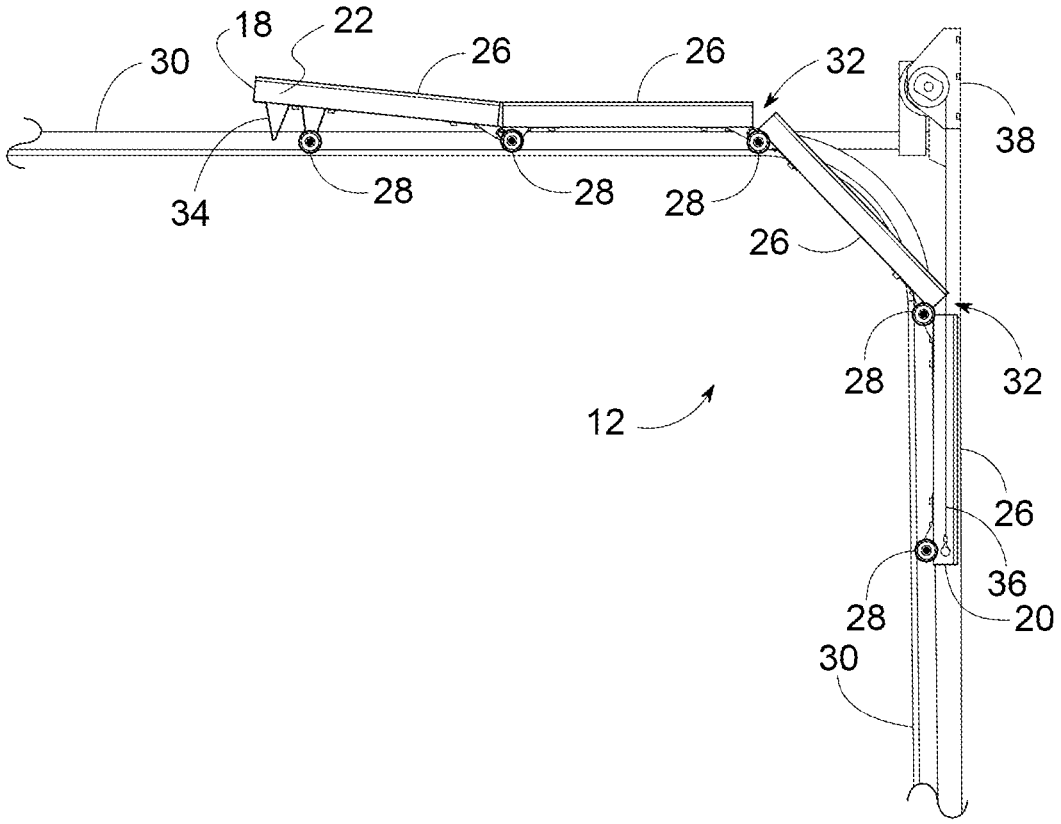
FIG. 2 is a side view of a typical sectional garage arranged is in a partially open position.

As shown, in FIG. 2, the garage door 12 includes a series of hinged door panels 26 having lateral wheels 28 adapted to ride along a track 30 to facilitate a movement of the garage door in the closed state and the open state. It may be appreciated that during the opening and closing of the garage door 12, gaps 32 are defined between the hinged panels 26. These gaps 32 increases the distance between the topmost edge 18 and bottommost edge 20 of the garage door 12 during opening and closing of the garage door 12. The cover assembly 10 is adapted to wrap the edges 18, 20, 22 to accommodate the increasing gaps 32 without interfering the door wheels 28, structure 34, cable 36, and mechanical components 38 of the garage door when the garage door 12 is opening or closing.

Figure 3:
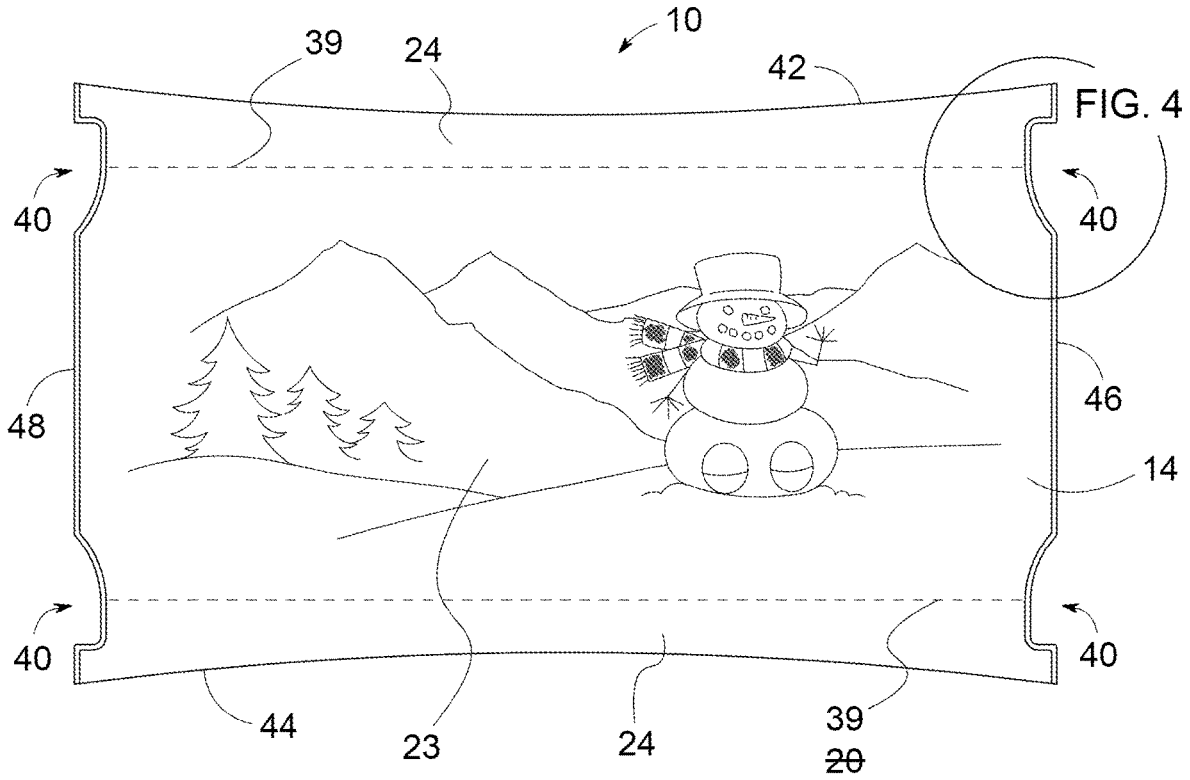
FIG. 3 is a front view of the cover assembly detached from the garage door.

Referring to FIG. 1 and FIG. 3, the cover 14 includes a front portion 23 (street facing portion 23) adapted to cover a street facing surface of the garage door 12, a pair of rear portions 24 (garage facing portions 24) adapted to cover at least a portion of a garage facing surface of the garage door 12, at least four collars 40, a first lateral edge 42, a second lateral edge 44, a first longitudinal edge 46, and a second longitudinal edge 48. One of the rear portions 24 extends from the first lateral edge 42 to the front portion 23, while the other of the rear portions 24 extends from the second lateral edge 44 to the front portion 23. Accordingly, the front portion 23 is arranged between the two rear portions 24 and is separated from the rear portions 24 by virtual lines 39 extending substantially parallel to the lateral edges 42,44. As shown, the first lateral edge 42 and the second lateral edge 44 are substantially parallel to each other and extend from the first longitudinal edge 46 to the second longitudinal edge 48. In an assembly of the cover 14 with the garage door 12, the first lateral edge 42 is arranged proximate to the topmost edge 18 of the garage door 12 and extends substantially parallel to the topmost edge 18, while the second lateral edge 44 is arranged proximate to the bottommost edge 20 of the garage door 12 and extends substantially parallel to the bottommost edge 20. Similarly, the first longitudinal edge 46 and the second longitudinal edge 48 extend along the sidemost edges 22 of the garage door 12. As shown in FIGS. 1 and 3, the illustration 16 is arranged on the front portion 23 of the cover 14.

Figure 4:
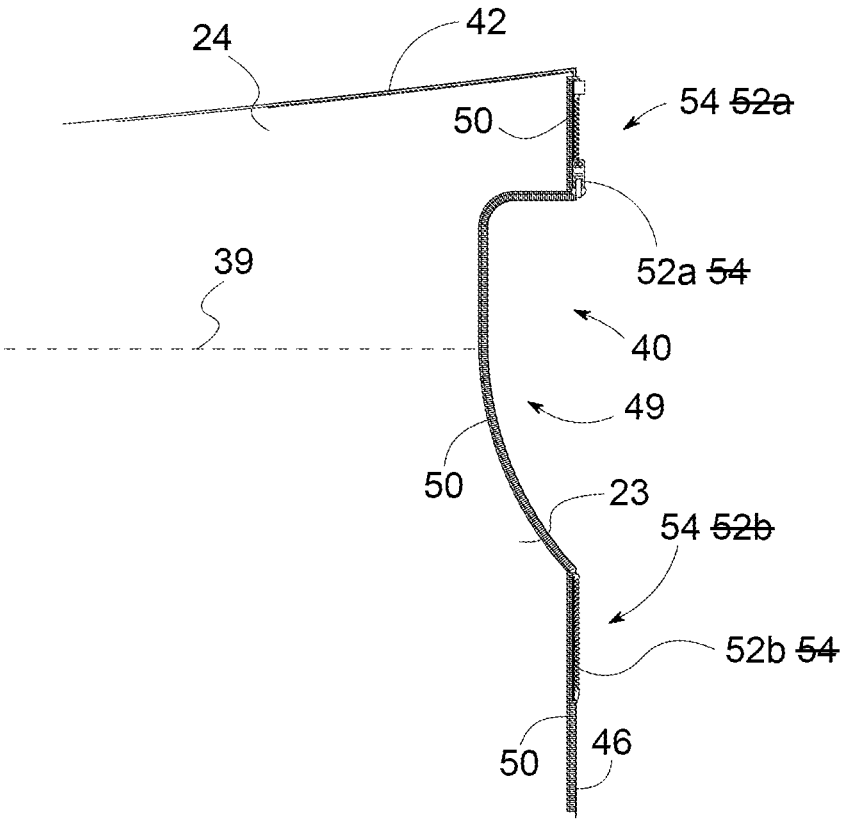
FIG. 4 is an enlarged view a portion of the cover assembly depicting a collar of a cover of the cover assembly.

As shown in FIG. 3, the collars 40 are adapted to be arranged at the four corners of the garage door 12. As shown, two of the collars 40 are defined along the first longitudinal edge 46, while the remaining two of the collars 40 are defined along the second longitudinal edge 48. It may be appreciated that each of the collars 40 is identical in structure and construction, and therefore, for the sake of clarity and brevity, a structure and a constructure of only one collar 40 is described in detail. As shown in FIG. 4, the collar 40 includes a cutout 49 defining along a longitudinal edge, for example, the first longitudinal edge 46, of the cover 14. The cutout 49 is formed by excising the cover 14 inwardly from the associated longitudinal edge, for example, the first longitudinal edge 46. In an embodiment, the cutout 49 extends both in the front portion 23 and the adjacent rear portion 24. In an embodiment, half of the cutout 49, and hence the collar 40 extends into the front portion 23 and remaining half of the cutout 49, and hence the collar 40, extends into the rear portion 24. Accordingly, the virtual lines 39 divide each of the collar 40 into two equal halves. However, it may be appreciated the portions of the cutout 49, and hence the collar 40, divided by the virtual lines 39 may be unequal. Each cutout 49 is formed by excising the cover 14 inwardly from the associated longitudinal edges 46, 48, and accommodates adequate clearance for garage door components 28, 34, 36, and 38. It is assumed a typical residential garage door 12 to have four corners, however the disclosure could reasonably accommodate garage doors with more or fewer corners. Positioning of the excised cutouts 49 and hence the collars 40 may be determined by superimposing the topmost edge 18 and the bottommost edge 20 of the garage door 12 onto the cover 14 running perpendicular to the right-edge 46 and left-edge 48. The dimension of the cutouts 49 is preferably between 4-6 inches in depth and 20-22 inches in length. It should be understood these dimensions are dependent on the size of typical residential garage door components 28, 34, 36, 38. Alternative embodiments of the disclosure may account for atypical residential, commercial or aviation garage doors requiring alternative collar dimensions. Additionally, while each collar 40 may have a symmetrical profile, it is anticipated that the preferred embodiment will likely exploit collar 40 of asymmetrical profiles; thus, accommodating a wider range of garage door types, hardware, and sizes.

Figures 6, 7:
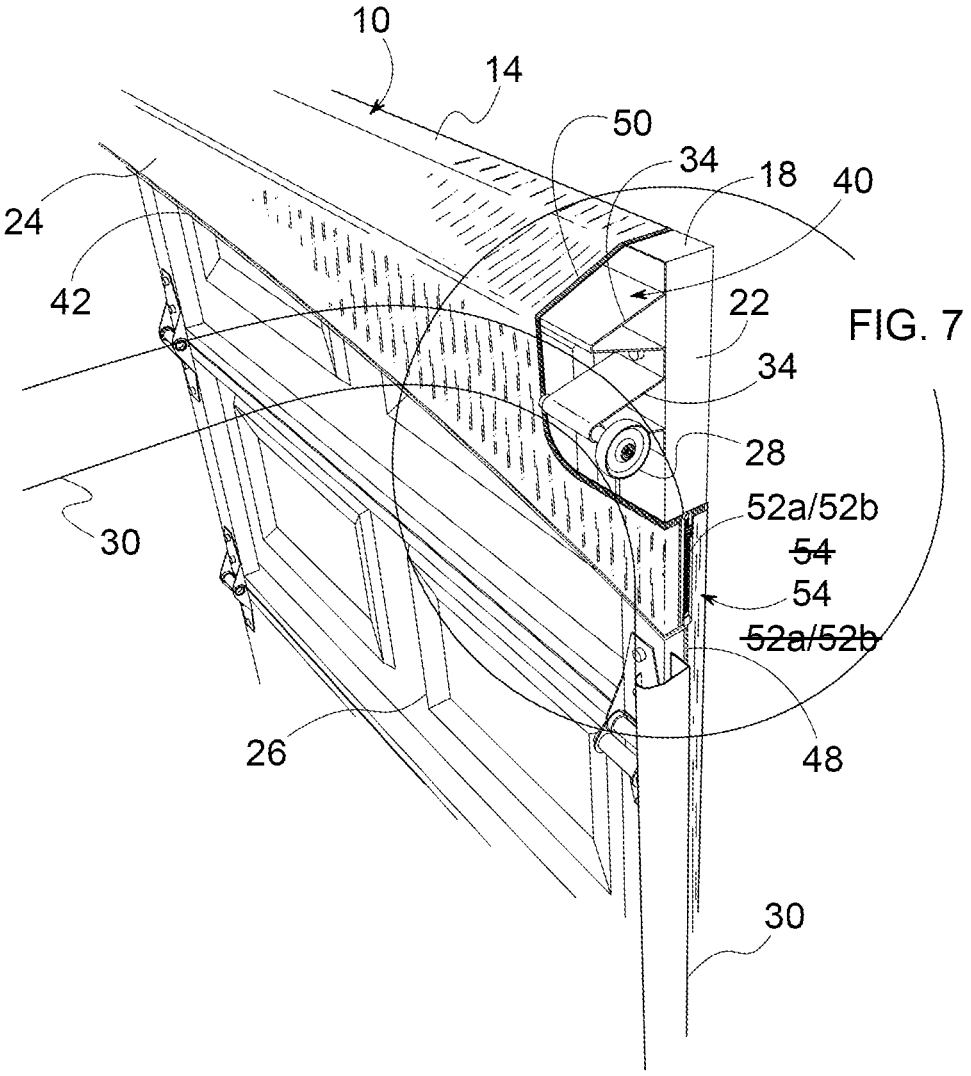
FIG. 6 is an enlarged perspective view of a portion of cover assembly depicting a corner of the garage door extending outwardly of a cutout of the collar.
FIG. 7 is an enlarged view of the sidemost edge of a garage door showing two examples of suitable couplers to facilitate the engagement of the coupling portions.
Figure 7:
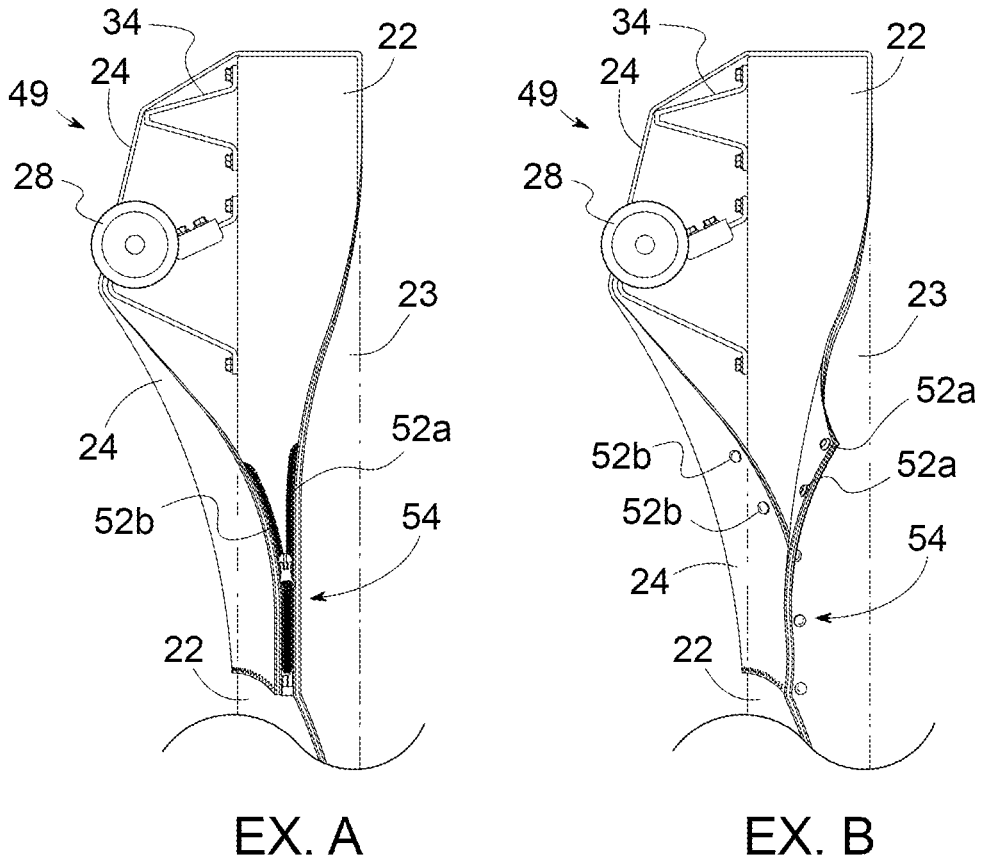

Turning now to FIG. 4 and FIG. 6, the collar 40 also include a first coupling portion 52*a* and a second coupling portion 52*b* disposed extending on opposite sides from the cutout 49 and running along the associated longitudinal edge, for example, the first longitudinal edge 46. As shown, the first coupling portion 52*a* is defined by the rear portion 24 of the cover 14, while the second coupling portion 52*b* is defined by the front portion 23 of the cover 14. Accordingly, the first coupling portion 52*a* extends from the associated cutout 49 to one of the lateral edges, for example, the first lateral edge 42, while the second coupling portion 52*b* extends in the opposite direction to that of the first coupling portion 52*a*. The dimension of each of the coupling portions 52*a*, 52*b* is preferably 7-8 inches in length. It should be understood these dimensions are dependent on the size of a typical residential garage door 12. Alternative embodiments of the disclosure shall account for atypical residential, commercial or aviation garage doors requiring dimensional alterations to the coupling portions 52*a*, 52*b*.

Figure 5:
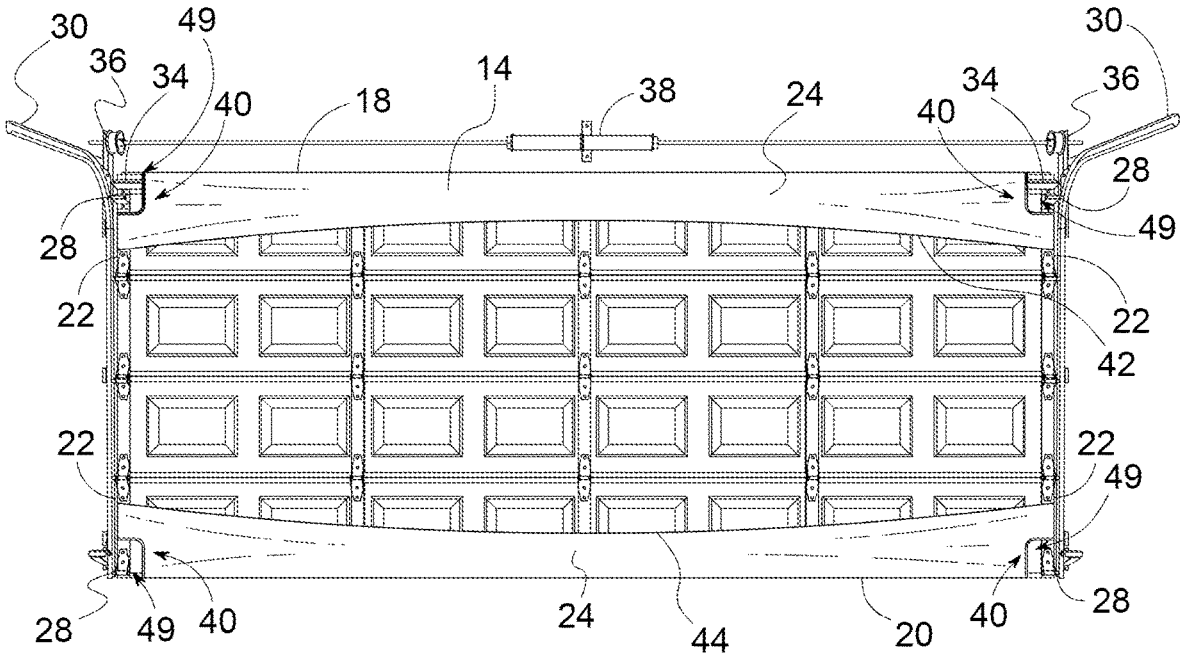
FIG. 5 is a rear view of the cover assembly attached to the garage door arranged in a closed position.

Further, as shown in FIG. 7, the cover assembly 10 includes a plurality of couplers 54, for example, EX. A depicts zippers attached to the coupling portions 52*a*, 52*b* of the collars to facilitate the engagement of the coupling portions 52*a*, 52*b* with each other. Although, the zipper is contemplated as the ideal coupler 54 for attaching the first coupling portion 52*a* to the second coupling portion 52*b* of each collar 40, it may be appreciated that the coupler 54 may be any other suitable attachment mechanism, such as, but not limited to, buttons as shown in FIG. 7 EX. B, laces, snaps, loop and hoop fasteners, or any suitable mechanism known in the art. As shown in FIG. 7, when the first coupling portion 52*a* and the second coupling portion 52*b* of each of the collars 40 are engaged, pockets are defined between the front portion 23 and the rear portions 24. The pockets receive the portions of the door disposed proximate to the topmost edge 18 and the bottommost edge 20 of the garage door 12 such that the topmost edge 18 and the bottommost edge 20 are arranged inside the pockets. Further, as shown in FIG. 5 and FIG. 6, in the assembly of the cover 14 with the garage door 12, the corners of the garage door 12 extend outside the cover 14 through the cut-outs 49 of the collars 40. In this manner, the cover 14 fully encompasses the garage door 12, while allowing the operation of the garage door components 28, 34, 36, and 38 unhindered while closing and opening. Additionally, each collar 40 may be provided with a reinforced hem 50 terminating along the first coupling portion 52*a* and the second coupling portion 52*b*. Each coupler 54 extends along the reinforced hem 50 of associated collar 40 and provide adequate resilience against the tensile stress of the front portion 23 and the rear portions 24, and repeated opening and closing wear of the garage door 12.

For mounting/installing the cover assembly 10 on the garage door 12, the cover 14 is positioned on the street-facing side of the garage door 12 such that a surface of the front portion 23 of the cover 14 having the illustration 16 is arranged facing the street. During the installation process, as reflected in FIG. 5, the rear portions 24 are wrapped over the topmost edge 18 and the bottommost edge 20 of the garage door 12. Accordingly, the front portion is arranged covering the street facing surface of the garage door and the rear portions 24 extend, at least partially, onto garage facing surface of the garage door 12. The rear portions 24 are wrapped around the topmost edge 18 and the bottommost edge 20 of the garage door 12 such that the corners of the garage door 12 extend outside the cover 14 through the cutouts 49 of the collars 40 of the cover 14. Subsequently, the first coupling portion 52*a* of each collar 40 is aligned with the associated second coupling portion 52*b* and the coupler 54 is engaged to attach the first coupling portion 52*a* with the associated second coupling portion 52*b*. In this manner, when properly installed, each collar 40 is positioned such that adequate clearance for garage door components 28, 30, 34 and 36 is maintained.

There have been described and illustrated herein an exemplary embodiment of an elastic garage door decorative cover. While the ideal embodiment of the invention has been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope.

What is claimed is:

1. A cover for a garage door, the cover comprising:

a front portion adapted to cover a street facing surface of the garage door;

a pair of rear portions adapted to be arranged covering a garage facing surface of the garage door, the front portion being arranged between the pair of rear portions; and at least four collars adapted to be arranged at corners of the garage door and arranged at interfaces of the front portion with each of the pair of rear portions, wherein each of the collars defines a cutout extending inwardly from an edge of the cover and adapted to facilitate an extension of an associated corner of the garage door outside the cover, a first coupling portion extending along one of the rear portions from the cutout to a lateral edge of the cover, and a second coupling portion extending from the cutout in a direction opposite to the first coupling portion and along a portion of a length of the front portion, wherein the first coupling portion is adapted to engage with the second coupling portion to removably engage the cover on the garage door.

2. The cover of claim 1, wherein each of the collars includes a reinforced hem.

3. The cover of claim 1, wherein the front portion of the cover includes at least one decorative illustration.

4. The cover of claim 1, wherein the cover is made of an elastic fabric.

5. The cover of claim 1 wherein the edge includes a first longitudinal edge and a second longitudinal edge arranged opposite to the first longitudinal edge, wherein the collars are defined along the first longitudinal edge and the second longitudinal edge.

6. A cover assembly for a garage door, the cover assembly comprising:

a cover including a front portion adapted to cover a street facing surface of the garage door, a pair of rear portions adapted to be arranged covering a garage facing surface of the garage door, the front portion being arranged between the pair of rear portions, and at least four collars adapted to be arranged at corners of the garage door and arranged at interfaces of the front portion with the pair of rear portions, wherein each of the collars defines a cutout extending inwardly from an edge of the cover and adapted to facilitate an extension of an associated corner of the garage door outside of the cover, a first coupling portion extending along one of the rear portions from the cutout to a lateral edge of the cover, and a second coupling portion extending from the cutout in a direction opposite to the first coupling portion and along a portion of a length of the front portion, wherein the first coupling portion is engaged with the second coupling portion to removably engage the cover on the garage door.

7. The cover assembly of claim 6 further including a plurality of couplers to engage the first coupling portion of each of the collars with the second coupling portion.

8. The cover assembly of claim 7, wherein the coupler is a zipper.

9. The cover assembly of claim 6, wherein each of the collars includes a reinforced hem.

10. The cover assembly of claim 6, wherein the front portion of the cover includes at least one decorative illustration.

11. The cover assembly of claim 6, wherein the cover is made of an elastic fabric.

12. The cover assembly of claim 6, wherein the edge includes a first longitudinal edge and a second longitudinal edge arranged opposite to the first longitudinal edge, wherein the collars are defined along the first longitudinal edge and the second longitudinal edge.

13. A cover assembly for a garage door, the cover assembly comprising:

a cover made of an elastic fabric, the cover including a front portion adapted to cover a street facing surface of the garage door, a pair of rear portions adapted to be arranged covering a garage facing surface of the garage door, the front portion being arranged between the pair of rear portions, and at least four collars adapted to be arranged at corners of the garage door and arranged at interfaces of the front portion with the pair of rear portions, wherein each of the collars defines a cutout extending inwardly from an edge of the cover and adapted to facilitate an extension of an associated corner of the garage door outside of the cover, a first coupling portion extending along one of the rear portions from the cutout to a lateral edge of the cover, and a second coupling portion extending from the cutout in a direction opposite to the first coupling portion and along a portion of a length of the front portion; and a plurality of couplers to engage the first coupling portion of each of the collars with the second coupling portion to removably engage the cover on the garage door.

14. The cover assembly of claim 13, wherein the coupler is a zipper.

15. The cover assembly of claim 13, wherein each of the collars includes a reinforced hem.

16. The cover assembly of claim 13, wherein the front portion of the cover includes at least one decorative illustration.

17. The cover assembly of claim 13, wherein the edge includes a first longitudinal edge and a second longitudinal edge arranged opposite to the first longitudinal edge, wherein the collars are defined along the first longitudinal edge and the second longitudinal edge.

* * * * *